US007454916B2

(12) United States Patent
Chazot

(10) Patent No.: US 7,454,916 B2
(45) Date of Patent: Nov. 25, 2008

(54) SYSTEM FOR CONTROLLING CRYOGENIC FLUID FLOW RATE AND JOULE-THOMSON EFFECT COOLER COMPRISING SAME

(75) Inventor: Dominique Chazot, Noyarey (FR)

(73) Assignee: L'Air Liquide, Societe Anonyme A Directorie et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 269 days.

(21) Appl. No.: 10/498,284

(22) PCT Filed: Nov. 20, 2002

(86) PCT No.: PCT/FR02/03972

§ 371 (c)(1),
(2), (4) Date: Oct. 5, 2004

(87) PCT Pub. No.: WO03/048657

PCT Pub. Date: Jun. 12, 2003

(65) Prior Publication Data

US 2005/0076653 A1 Apr. 14, 2005

(30) Foreign Application Priority Data

Dec. 5, 2001 (FR) ..... 01 15706

(51) Int. Cl.
*F25B 19/02* (2006.01)
*F16K 31/00* (2006.01)

(52) U.S. Cl. ..... 62/51.2; 251/11

(58) Field of Classification Search ..... 62/51.2, 62/527; 251/11
See application file for complete search history.

(56) References Cited

U.S. PATENT DOCUMENTS

| | | | | |
|---|---|---|---|---|
| 3,719,322 | A | 3/1973 | Gifford | |
| 4,152,903 | A * | 5/1979 | Longsworth | 62/222 |
| 4,177,650 | A | 12/1979 | Campbell | |
| 4,419,867 | A | 12/1983 | Albagnac et al. | |
| 4,468,935 | A | 9/1984 | Albagnac | |
| 4,631,928 | A * | 12/1986 | Walker | 62/51.2 |
| 4,738,122 | A * | 4/1988 | Walker | 62/51.2 |
| RE34,748 | E * | 10/1994 | Brown | 62/51.2 |
| 5,365,750 | A * | 11/1994 | Greenthal | 62/293 |
| 2001/0030040 | A1 * | 10/2001 | Xiao | 165/154 |

FOREIGN PATENT DOCUMENTS

| | | | |
|---|---|---|---|
| EP | 84308 | * | 7/1983 |
| EP | 0 170 948 | | 7/1985 |
| EP | 0170948 | * | 9/1987 |
| EP | 245164 | * | 11/1987 |

(Continued)

*Primary Examiner*—William C Doerrler
(74) *Attorney, Agent, or Firm*—Christopher J. Cronin

(57) ABSTRACT

A cryogenic fluid flow control system. This cryogenic fluid flow control system utilizes a first element forming a fluid inlet channel and an outlet passage that can be selectively blocked off by a second element that can move relative to the first element by an effect due to the difference in expansion coefficients between the materials of the first and second elements. The outlet passage utilizes a part extending transversely relative to the inlet channel and emerging on the periphery of an end part of the first element, the second element being placed at least partly around said end part.

11 Claims, 2 Drawing Sheets

FOREIGN PATENT DOCUMENTS

| | | | |
|---|---|---|---|
| EP | 69346 | * | 1/1993 |
| FR | 597993 | * | 12/1925 |
| FR | 2136023 | * | 11/1972 |
| FR | 2 377 588 | | 1/1978 |
| FR | 2377588 | * | 1/1978 |
| FR | 2665753 | * | 2/1992 |
| FR | 2725013 | * | 3/1996 |

* cited by examiner

SYSTEM FOR CONTROLLING CRYOGENIC FLUID FLOW RATE AND JOULE-THOMSON EFFECT COOLER COMPRISING SAME

BACKGROUND

The present invention relates to cryogenic fluid flow control systems of the type comprising a first element forming a fluid inlet channel and an outlet passage that can be selectively blocked off by a second element that can move relative to the first element by an effect due to the difference in expansion coefficients between the materials of the first and second elements.

Known flow control systems of this type, such as those described for example in documents FR-A-2 377 588 or EP-A-0 170 948, comprise a needle that can move longitudinally relative to an outlet orifice due to the effect of axial differential expansions between the first element having the orifice and a moveable device that includes a rod and/or a bellows supporting the needle, in an arrangement that is tricky to manufacture and assemble, and therefore expensive and with no guarantee of reliability, especially in the presence of vibrations.

The object of the present invention is to propose a system of the type defined above that is of simple, robust and inexpensive construction and is of greater reliability.

SUMMARY

To do this, according to one aspect of the invention, the outlet passage comprises a part extending transversely relative to the fluid inlet channel and emerging on the periphery of an end region of the first element, the second element being placed at least partly around this end region.

According to more particular features of the invention:

- the end region of the first element is approximately cylindrical and the second element is annular and coaxial with said end region;
- the outlet passage includes a downstream part of reduced section that cannot be blocked off by the second element;
- this downstream part consisting of an axial groove formed in the periphery of the end region or of a capillary tube that extends the inlet channel through the end region;
- at least one of the first and second elements is made of a plastic or a metallic material.

The subject of the present invention is also a Joule-Thomson expansion cooler, especially for a cryostat, that includes such a cryogenic fluid flow control system.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
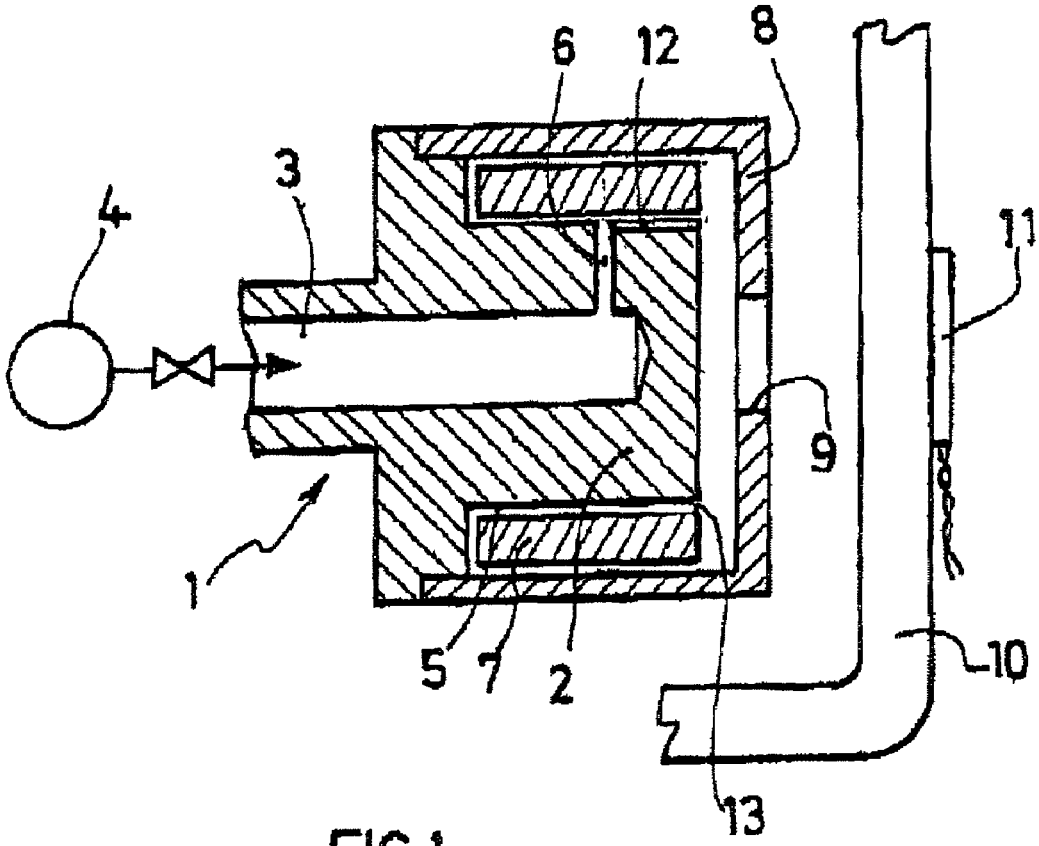
FIG. 1 is a schematic view in partial section in accordance with a first illustrative embodiment of the present invention.

In the description that follows and in the drawings, identical or similar elements bear the same reference numbers.

FIG. 1 shows the downstream end of one embodiment of a flow control system for a cryostat with a Joule-Thomson cooler.

This system comprises a first elongate element, denoted overall by the reference 1, which terminates in an end part 2 of enlarged diameter and along which first element there extends a blind bore 3 which selectively communicates with a source 4 of pressurized gas, for example nitrogen or argon.

According to one aspect of the invention, the end part 2 forms a cylindrical peripheral region 5 into which at least one radial transverse passage 6 emerges. Placed around the cylindrical peripheral region 5, normally loosely, is a second annular element or ring 7 held in place, in the example shown, around the peripheral region 5 by a cover 8 fitted over the end part 2 and provided with an axial orifice 9 facing the end wall 10 of a casing, for example made of metal, in which the flow control system is mounted, the said casing carrying, for example, an infrared detection cell 11. The ring 7 may be held in place around the peripheral region 5 by a simple stop, of the strap or pin type inserted into the end part 2. In the embodiment shown in FIG. 1, an axial groove 12 emerging upstream into the radial passage 6 and downstream into the lower face of the end part 2 is formed in the peripheral region 5.

The annular ring 7 is made of a material having an expansion coefficient substantially higher than that of the central element 1 and so the operation of the system is as follows:

Before injection of the gas to be expanded, that is to say at room temperature, an annular outlet passage 13 of cross section substantially larger than that of the passage 6 exists between the ring 7 and the surface 5.

When the cryogenic fluid is injected into the bore 3, its expansion upon leaving the flow control system via the passages 6 and 13 causes rapid cooling of the entire system, resulting in contraction of the ring 7 around the end part 2 and resulting in rapid disappearance of the annular outlet passage 13. Consequently, the compressed gas to be expanded can now escape only via the axial groove 12, that is to say with a much smaller flow rate than previously via the annular passage 13, thus making it possible to ensure continuous expansion for maintaining the refrigeration of the cryostat at the cost of a small tap-off of gas.

Figure 2:
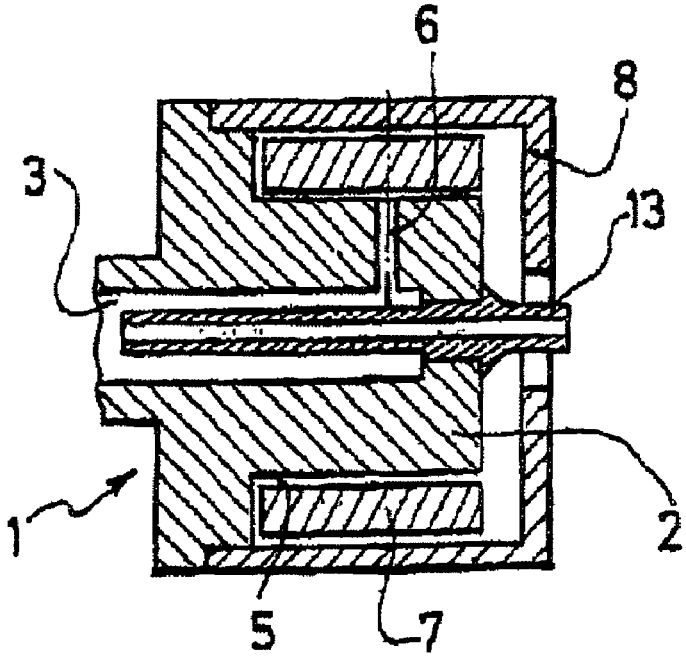
FIG. 2 is a schematic view similar to FIG. 1 of another illustrative embodiment of the present invention.

In the embodiment shown in FIG. 2, the gas outlet passage of small cross section is produced by a capillary tube 13 that passes through the end wall of the end part 2, being brazed to the latter and extending into the bore 3 forward of the radial passage 6 and advantageously beyond the opening 9 in the cover 8, in order to direct the reduced flow of cold fluid directly onto the region of the cell 11.

Figure 3:
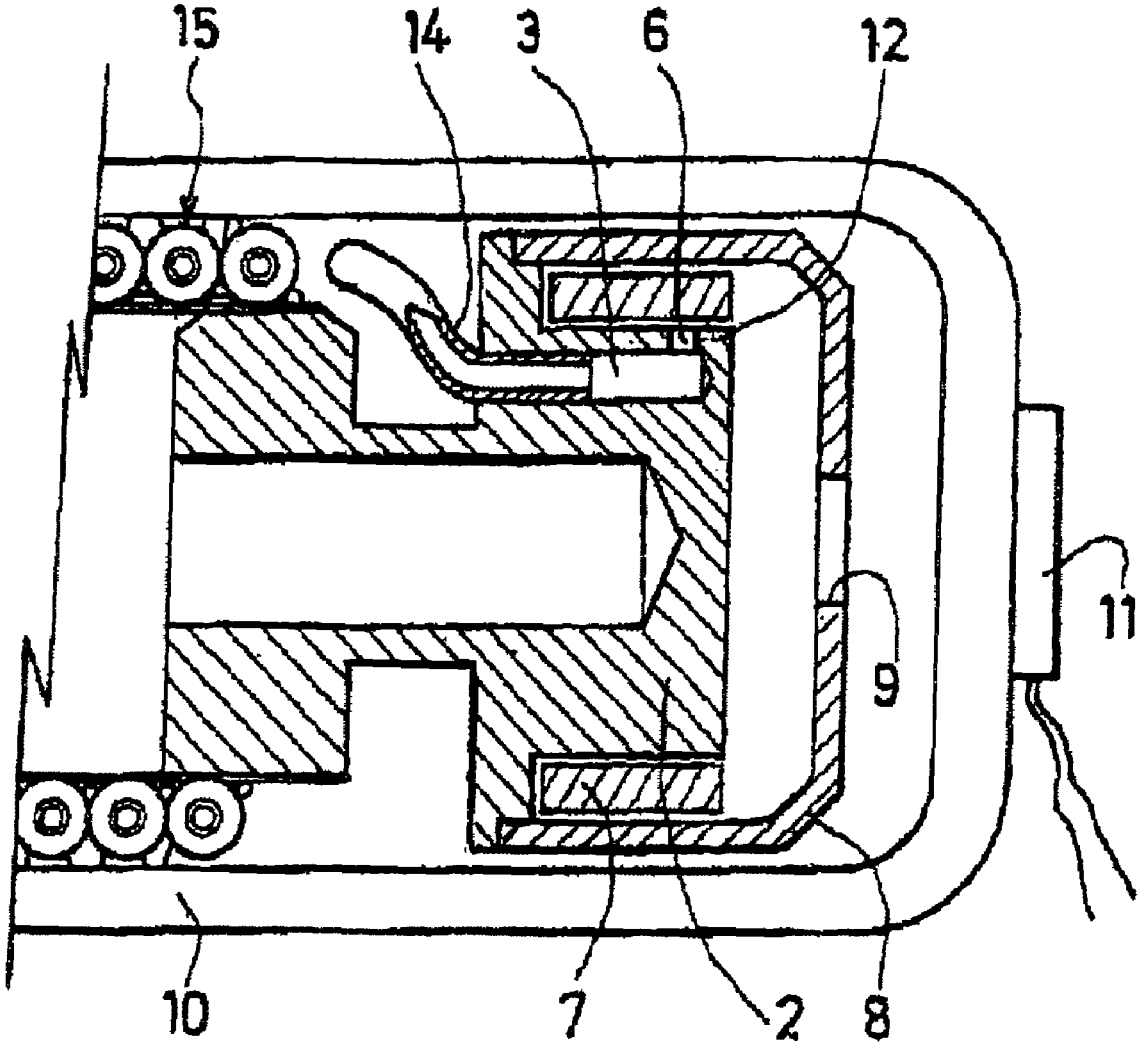
FIG. 3 is a partial view, in section, of a cryostat incorporating a Joule-Thomson cooler in accordance with an illustrative embodiment of the present invention.

In the cryostat embodiment shown in FIG. 3, the flow control system is similar to that shown in FIG. 1, but the blind hole 3, where the radial passage 6 emerges, is offset laterally, in the end part 2, near the axial leakage groove 12, and the working gas is conveyed by a tube 14, the downstream end of which is fitted into the bore 3 and brazed thereto, and the upstream region of said tube has the shape of a spiral in order to form a heat exchanger coil 15 extending axially into the casing 10 of the cryostat.

For moderate gas pressures (not exceeding 200 bar), the element 1 may be made of a plastic, for example a polyamide, and the ring 7 may be made of a plastic, for example cavity Teflon™.

For moderated and high gas pressures, the elements 1 and 7 are made of metal, advantageously Invar and aluminum respectively. The ring 7 may also be made of copper or a copper alloy.

Although the invention has been described in relation to particular embodiments, it is not limited thereby but is capable of modifications and variants that will become apparent to a person skilled in the art within the context of the claims appended hereto. In particular, the invention may apply in any type of Joule-Thomson geometry, for example one that is conical or flat.

The invention claimed is:

1. A cryogenic fluid flow control system apparatus, comprising:

a) a first element, wherein said first element comprises an end part with a periphery, and wherein said first element forms a fluid inlet channel extending in an axial direction and an outlet passage; and b) a second element, that can move in a radial direction relative to the first element by an effect due to the difference in expansion coefficients between the materials of the first and second elements, wherein the radial movement of the second element toward the first element selectively blocks off the outlet passage, wherein the outlet passage comprises a part extending transversely outwardly relative to the inlet channel and emerging on the periphery of the end part of the first element, with the second element being placed at least partly around said end part.

2. The apparatus of claim 1, wherein said end part is approximately cylindrical and said second element is annular and coaxial with said end part.

3. The apparatus of claim 1, wherein said outlet passage further comprises a second part of reduced section that cannot be blocked off by said second element.

4. A cryogenic fluid flow control system apparatus, comprising:

a) first element, wherein said first element comprises an end part with a periphery, and wherein said first element forms a fluid inlet channel extending in an axial direction and an outlet passage; and b) a second element, that can move in a radial direction relative to the first element by an effect due to the difference in expansion coefficients between the materials of the first and second elements, wherein the radial movement of the second element toward the first element selectively blocks off the outlet passage, wherein the outlet passage comprises a part extending transversely relative to the inlet channel and emerging on the periphery of the end part of the first element, with the second element being placed at least partly around said end part, wherein said second part of the outlet passage further comprises an axial groove formed in said periphery of the end part of the first element.

5. The apparatus of claim 3, wherein said second part of the outlet passage is formed by a capillary tube that extends the inlet channel through the end part of the first element.

6. The apparatus of claim 1, wherein at least one of said first and second elements comprises a plastic.

7. The apparatus of claim 1, wherein at least one of said first and second elements comprises a metallic material.

8. A Joule-Thomson cooler apparatus comprising a flow control system, wherein said flow control system comprises:

a) a first element, wherein said first element comprises an end part with a periphery, and wherein said first element forms a fluid inlet channel extending in an axial direction and an outlet passage; and b) a second element, that can move in the radial direction relative to the first element by an effect due to the difference in expansion coefficients between the materials of the first and second elements, wherein the radial movement of the second element toward the first element selectively blocks off the outlet passage, wherein the outlet passage comprises a part extending transversely relative to the inlet channel and emerging on the periphery of the end part of the first element, with the second element being placed at least partly around said end part.

9. A cryogenic fluid flow control system apparatus, comprising:

a) an elongate first element terminating at an end part having a cylindrical periphery, wherein:

i) said end part has an axially extending fluid inlet channel formed therein and an outlet passage formed therein that fluidly communicates with, and extends transversely from, said fluid inlet channel, and ii) at least a portion of said outlet passage extends in a radial direction and emerges through said end part cylindrical periphery; and b) an annular second element disposed around said end part cylindrical periphery where said outlet passage portion emerges therethrough, said second element having a coefficient of expansion higher than that of said first element.

10. A cryogenic fluid flow control system apparatus, comprising:

a) an elongate first element terminating at an end part having a cylindrical periphery, wherein:

i) said end part has an axially extending fluid inlet channel formed therein and an outlet passage formed therein that fluidly communicates with, and extends transversely from, said fluid inlet channel, and ii) at least a portion of said outlet passage extends in a radial direction and emerges through said end part cylindrical periphery; and b) an annular second element disposed around said end part cylindrical periphery where said outlet passage portion emerges therethrough, said second element having a coefficient of expansion higher than that of said first element, wherein said end part has an axial groove formed in said cylindrical periphery that extends from said emergence of said outlet passage thereat.

11. The apparatus of claim 9, further comprising a capillary tube extending axially from said fluid inlet channel and emerging through an axial terminus of said first element.

* * * * *